US005746866A

United States Patent [19]

Tanaka et al.

[11] Patent Number: 5,746,866

[45] Date of Patent: May 5, 1998

[54] HEAT SENSITIVE INK SHEET AND IMAGE FORMING METHOD

[75] Inventors: Toshiharu Tanaka; Mitsuru Yamamoto, both of Shizuoka, Japan

[73] Assignee: Fuji Photo Film Co., Ltd., Kanagawa, Japan

[21] Appl. No.: 637,272

[22] Filed: Apr. 25, 1996

[30] Foreign Application Priority Data

Apr. 25, 1995 [JP] Japan ..... 7-124453

[51] Int. Cl.[6] ..... B41M 5/26; B41M 5/40

[52] U.S. Cl. ..... 156/234; 156/230; 156/277; 427/146; 427/148; 428/195; 428/206; 428/207; 428/323; 428/331; 428/913; 428/914; 430/945

[58] Field of Search ..... 428/195, 206, 428/337, 913, 914, 207, 323, 331; 427/146, 148; 156/230, 234, 277; 430/945

[56] References Cited

U.S. PATENT DOCUMENTS 5,071,502 12/1991 Hashimoto et la. ..... 156/234

5,328,746 7/1994 Okuyama et al. ..... 428/195

FOREIGN PATENT DOCUMENTS 513072 2/1993 Japan ..... 156/234

*Primary Examiner*—Bruce H. Hess

*Attorney, Agent, or Firm*—Birch, Stewart, Kolasch and Birch, LLP

[57] ABSTRACT

Disclosed is a heat sensitive ink sheet having a support sheet and a heat sensitive ink layer having a thickness of 0.2 to 1.0 μm which is formed of a heat sensitive ink material comprising 30–70 wt. % of colored pigment, 25–65 wt. % of amorphous organic polymer having a softening point of 40° to 150° C. and 0.5–25 wt. % of colorless fine particles. Further, thermal transfer recording methods by area gradation using the heat sensitive ink sheet and an image receiving sheet are also disclosed.

7 Claims, 3 Drawing Sheets

HEAT SENSITIVE INK SHEET AND IMAGE FORMING METHOD

FIELD OF THE INVENTION

This invention relates to an image forming method and a heat sensitive ink sheet favorably employable for the method. In particular, the invention relates to an image forming method for forming a multicolor image on an image receiving sheet by area gradation using a thermal head or laser beam.

BACKGROUND OF THE INVENTION

Heretofore, there have been known two representative methods for thermal transfer recording for the preparation of a multi-color image which uses a thermal head printer, that is, a sublimation dye transfer recording method and a fused ink transfer recording method.

The sublimation dye transfer recording method comprises the steps of superposing on an image receiving sheet an image transfer sheet which is composed of a support and an image transfer layer comprising a sublimation ink and a binder and imagewise heating the support of the transfer sheet to sublimate the sublimation ink to form an image on the image receiving sheet. A multicolor image can be prepared using a number of color transfer sheets such as a yellow transfer sheet, a magenta transfer sheet, and a cyan transfer sheet.

The sublimation dye transfer recording method, however, has the following drawbacks:

1) The gradation of image is mainly formed of variation of the sublimated dye concentration, which is varied by controlling the amount of sublimation of the dye. The gradation is appropriate for the preparation of a photographic image, but is inappropriate for the preparation of a color proof which is utilized in the field of printing and whose gradation is formed of dots, lines, or the like, that is, area gradation.
2) The image formed of sublimated dye has poor edge sharpness, and a fine line shows thinner density on its solid portion than a thick line. The tendency causes serious problem in the quality of character image.
3) The image of sublimated dye is poor in endurance. The image cannot be used in the fields which require multicolor images resistant to heat and light.
4) The sublimation dye transfer recording shows sensitivity lower than the fused ink transfer recording. Such low sensitive recording method is not preferably employable in a high speed recording method utilizing a high resolution thermal head, of which development is expected in the future.
5) The recording material for the sublimation dye transfer recording is expensive, as compared with the recording material for the fused ink transfer recording.

The fused ink transfer recording method comprises the steps of superposing on an image receiving sheet an image transfer sheet having support and a thermal fusible transfer layer which comprises a coloring material (e.g., pigment or dye) and imagewise heating the support of the transfer sheet to portionwise fuse the transfer layer to form and transfer an image onto the image receiving sheet. A multicolor image also can be prepared using a number of color transfer sheets.

The fused ink transfer recording method is advantageous in the sensitivity, cost, and endurance of the formed image, as compared with the sublimation dye transfer recording method. It, however, has the following drawbacks:

The color image prepared by the fused ink transfer recording method is poor in its quality, as compared with the sublimation dye transfer recording method. This is because the fused ink transfer recording utilizes not gradation recording but binary (i.e., two valued) recording. Therefore, there have been reported a number of improvements on the fusible ink layer of the fused ink transfer recording method for modifying the binary recording to give gradation recording so that a color image having multi-gradation is prepared by the fused ink transfer recording method. The basic concept of the heretofore reported improvement resides in portionwise (or locally) controlling the amount of the ink to be transferred onto the image receiving sheet. In more detail, the mechanism of transfer of the ink in the fused ink transfer recording method is as follows; under heating by the thermal head, the viscosity of the ink layer at the site in contact with the thermal head lowers and the ink layer tends to adhere to the image receiving sheet, whereby the transfer of the ink takes place. Therefore, the amount of the transferred ink can be controlled by varying degree of elevation of temperature on the thermal head so that the cohesive failure in the ink layer is controlled and the gamma characteristic of the transferred image is varied. Thus, the optical density of the transferred ink image is portionwise varied, and accordingly, an ink image having gradation is formed. However, the optical density of a fine line produced by the modified fused ink transfer recording is inferior to that produced by the sublimation dye transfer recording method. Moreover, the optical density of a fine line produced by the modified fused ink transfer recording method is not satisfactory.

Further, the fused ink transfer recording method has other disadvantageous features such as low resolution and poor fixation of the transferred ink image. This is because the ink layer generally uses crystalline wax having a low melting point as the binder, and the wax tends to spread on the receiving sheet in the course of transferring under heating. Furthermore, the crystalline wax scarcely gives a transparent image due to light scattering on the crystalline phase. The difficulty in giving a transparent image causes serious problems in the preparation of a multicolor image which is formed by superposing a yellow image, a magenta image, and a cyan image. The requirement to the transparency of the formed image restricts the amount of a pigment to be incorporated into the ink layer. For instance, Japanese Patent Publication No. 63(1988)-65029 describes that the pigment (i.e., coloring material) should be incorporated in the ink layer in an amount of not more than 20 weight % based on the total amount of the ink layer. If an excessive amount of the pigment is employed, the transparency of the transferred ink image is made dissatisfactory.

Improvements of reproduction of a multicolor image in the fused ink transfer recording have been studied and proposed, so far. For instance, Japanese Patent Provisional Publication No. 61(1986)-244592 (=Japanese Patent Publication No. 5(1993)-13072) describes a heat sensitive recording material which has a heat sensitive layer comprising at least 65 weight % of an amorphous polymer, a releasing agent, and a coloring material (dye or pigment) which can reproduce a color image having continuous gradation with improved transparency and fixation strength. The publication indicates that the amorphous polymer in an amount of 65 weight % or less gives a heat sensitive ink layer of extremely poor transparency and therefore cannot reproduce a satisfactory color image, and at least 70 weight % of the amorphous polymer is required to give a sufficiently transparent ink layer. Further, the amount of the coloring material is required to be not more than 30 weight % to obtain the sufficiently transparent ink layer. As for the thickness of the heat-sensitive ink layer, it is described that 0.5 μm to 50 μm, specifically 1 μm to 20 μm, is preferred to obtain practical density or strength of an image. In the working examples, the thickness of the ink layer is approximately 3 μm which is similar to that of the conventional ink layer using wax binder. Furthermore, the publication indicates that the heat sensitive recording material can also utilize binary recording and multi-valued recording (i.e., image recording method utilizing multi-dots having area different from one another; VDS (Variable Dot System)).

The study of the inventors has clarified that recording by the continuous gradation using the heat sensitive recording material of the publication does not give a image having satisfactory continuity and stability of density. Further, the binary or multi-valued recording using the heat sensitive recording material does not give a image having satisfactory continuity of density, transparency (especially transparency of multicolor image) and sharpness in edge portion.

In contrast, it is known that the thermal transfer recording method can prepare a multicolor image having multi-gradation by means of the multi-valued recording which utilizes area gradation. Further, it is also known that a heat sensitive ink sheet which can be used in the multi-valued recording utilizing area gradation, preferably have the following characteristics:

(1) Each color image (i.e., cyan image, magenta image or yellow image) of the multicolor image for color proofing should have a reflection density of at least 1.0, preferably not less than 1.2, and especially not less than 1.4, and a black image preferably has a reflection density of not less than 1.5. Thus, it is desired that the heat sensitive ink sheet has the above reflection densities.

(2) An image which is produced by area gradation is satisfactory.

(3) An image can be produced in the form of dots, and the formed line or point has high sharpness in the edge.

(4) An ink layer (image) transferred has high transparency.

(5) An ink layer has high sensitivity.

(6) An image transferred onto a white paper (e.g., coated paper) should be analogous to a printed image in tone and surface gloss.

As for the thermal head printer, the technology has been very rapidly developed. Recently, the thermal head is improved to give a color image with an increased resolution and multi-gradation which is produced by area gradation. The area gradation means gradation produced not by variation of optical density in the ink area but by size of ink spots or lines per unit area. Such technology is described in Japanese Patent Provisional Publications No. 4(1992)-19163 and No. 5(1993)-155057 (for divided sub-scanning system) and the preprint of Annual Meeting of Society of Electrography Jul. 6, 1992 (for heat concentrated system).

As a transfer image forming method using the heat sensitive ink sheet, recently a method using a laser beam (i.e., digital image forming method) has been developed. The method comprises the steps of: superposing the heat sensitive ink layer of the heat sensitive ink sheet on an image receiving sheet, and applying a laser beam modulated by digital signal on the heat sensitive ink layer through the support of the heat sensitive ink sheet to form and transfer an image of the heat sensitive ink layer onto the image receiving sheet (the image can be further retransferred onto other sheet). In the method, the heat sensitive ink sheet generally has a light-heat conversion layer provided between the ink layer and the support to efficiently convert light energy of laser beam into heat energy. The light-heat conversion layer is a thin layer made of carbon black or metal. Further, a method for locally peeling the ink layer to transfer the peeled ink layer onto the image receiving sheet (i.e., ablation method), which does not fuse the layer in the transferring procedure, is utilized in order to enhance image quality such as evenness of reflection density of the image or sharpness in edges of the image.

SUMMARY OF THE INVENTION

The known heat sensitive ink sheets do not satisfactorily have excellent characteristics described above. The copending application discloses that a thin layer heat-sticking-peeling method (i.e., method using a heat sensitive ink sheet provided with a thin ink layer containing pigment in high content) is advantageous for giving an image having excellent characteristics described above (see U.S. application Ser. No. 08/327,409 or EP Application No. 94116673.8). The use of the above heat sensitive ink sheet gives a high quality color or monochrome image with multi-gradation which is produced by area gradation, and therefore the ink sheet is useful for not only the usual image forming method but also preparation of color proof in the printing field and block copy. Further, the pigments contained in the ink sheet have good durability and therefore the ink sheet is also useful for preparation of elements employed in the fields of the recording or recorded card and outdoor or meter display.

Although the heat sensitive ink sheet used in the thin layer heat-sticking-peeling method can give a satisfactory image which has dots having preferable size and shape and good reproduction of gradation, the image obtained from the ink sheet gives glistening.

In more detail, in the case that the image formed of the ink layer is transferred onto the image receiving sheet, the surface of the transferred image has a high reflectivity. Further, the image is present in the form of extremely thin layer (0.2 to 1 μm), and therefore the image is apt to generate interference of reflected light on the surface. It is considered that the high reflectivity and interference give the glistening. Further, in the case of superposing color images to form a multicolor image, the interference is amplified to extremely increase the glistening. Thus, the resultant transferred image is difficult to see.

Even though the transferred image onto the image receiving layer (sheet) shows remarkable glistening, a retransferred image onto a white paper sheet (for printing) does not remarkable glistening because the surface of the white paper sheet is unevenness. However, in the case that the transferred image is checked against an original image before the transferred image is retransferred onto the white sheet paper, the glistening of the transferred image gives some troubles for checking the image.

An object of the present invention is to provide a heat sensitive ink sheet satisfying the characteristics described above (1) to (6), which is suitable for image forming method by multi-gradation.

Another object of the invention is to provide a heat sensitive ink sheet giving an image which has dots having preferable size and shape (i.e., near to predetermined size and shape) and good reproduction of gradation and further which is almost free from glistening (i.e., large fluctuation of reflectance on a surface of the image caused by viewing angle).

A further object of the invention is to provide an image forming method which uses the heat sensitive ink sheet.

The inventors have studied to obtain an image almost free from the glistening in the thin layer heat-sticking-peeling method. As a result, the inventors have found that the incorporation of colorless fine particles into the ink layer can give an image which is almost free from glistening as well as has dots having preferable size and shape and good reproduction of gradation.

There is provided by the present invention a heat sensitive ink sheet having a support sheet and a heat sensitive ink layer having a thickness of 0.2 to 1.0 μm which is formed of a heat sensitive ink material comprising 30 to 70 weight % of colored pigment, 25 to 65 weight % of amorphous organic polymer having a softening point of 40° to 150° C., and 0.5 to 25 weight % of colorless fine particles.

The preferred embodiments of the above-mentioned heat sensitive ink sheet are as follows:

1) The heat sensitive ink sheet wherein at least 70 weight % of the colored pigment has a particle size of 0.1 to 1.0 μm.

2) The heat sensitive ink sheet wherein the colorless fine particles are silica particles.

3) The heat sensitive ink sheet wherein the heat sensitive ink layer contains an amide compound.

4) The heat sensitive ink sheet wherein the heat sensitive ink layer contains an amide compound having the formula (I):

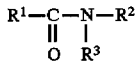

in which $R^1$ represents an alkyl group of 8 to 24 carbon atoms, an alkoxyalkyl group of 8 to 24 carbon atoms, an alkyl group of 8 to 24 carbon atoms having a hydroxyl group, or an alkoxyalkyl group of 8 to 24 carbon atoms having a hydroxyl group, and each of $R^2$ and $R^3$ independently represents a hydrogen atom, an alkyl group of 1 to 12 carbon atoms, an alkoxyalkyl of 1 to 12 carbon atoms, an alkyl group of 1 to 12 carbon atoms having a hydroxyl group, or an alkoxyalkyl group of 1 to 12 carbon atoms having a hydroxyl group, provided that $R^1$ is not the alkyl group in the case that $R^2$ and $R^3$ both represent a hydrogen atom.

5) The heat sensitive ink sheet wherein the colorless fine particles have a mean a particle size of 0.005 to 1.5 μm (especially a particle size of 0.01 to 0.7 μm).

6) The heat sensitive ink sheet wherein the amorphous organic polymer is butyral resin or styrene/maleic acid half-ester resin.

7) The heat sensitive ink sheet wherein the thickness of the heat sensitive ink layer is in the range of 0.2 to 0.6 μm.

There is also provided by the present invention an image forming method which comprises the steps of:

superposing the above heat sensitive ink sheet (i.e., claim 1) on an image receiving sheet; and separating the support of the heat sensitive ink sheet from the image receiving sheet so that the image of the ink material can be retained on the image receiving sheet, said image of the ink material on the image receiving sheet having an optical reflection density of at least 1.0.

The image forming method may further contains the steps of:

superposing the image receiving sheet having the image of the ink material on a white paper sheet in such a manner that the image of the ink material is in contact with a surface of the white paper sheet; and separating the image receiving sheet from the white paper sheet, keeping the image of the ink material on the white paper sheet, said image of the ink material on the white paper sheet having an optical reflection density of at least 1.0.

There is further provided by the invention a thermal transfer recording method which comprises the steps of:

superposing the above heat sensitive ink sheet on an image receiving sheet;

irradiating a laser beam modulated by digital signals on the heat sensitive ink layer through the support of the heat sensitive ink sheet to form an image of the ink material on the image receiving sheet; and separating the support of the heat sensitive ink sheet from the image receiving sheet so that the image of the ink material can be retained on the image receiving sheet, said image of the ink material on the image receiving sheet having an optical reflection density of at least 1.0.

After irradiation of a laser beam, the formation of the image of the ink material on the image receiving sheet can be done through ablation of the image from the support of the heat sensitive ink sheet.

The image forming method may further contains the steps of:

superposing the image receiving sheet having the image of the ink material on a white paper sheet in such a manner that the image of the ink material is in contact with a surface of the white paper sheet; and separating the image receiving sheet from the white paper sheet, keeping the image of the ink material on the white paper sheet, said image of the ink material on the white paper sheet having an optical reflection density of at least 1.0.

The method of the invention can be utilized advantageously in preparation of a color proof of full color type.

In more detail, the preparation of a color proof can be performed by the steps of:

superposing a first heat sensitive ink sheet (such as a cyan ink sheet) on an image receiving sheet;

placing imagewise a thermal head on the support of the first heat sensitive ink sheet to form and transfer a color image (cyan image) of the heat sensitive ink material onto the image receiving sheet;

separating the support of the ink sheet from the image receiving sheet so that the color image (cyan image) of the heat sensitive ink material is retained on the image receiving sheet;

superposing a second heat sensitive ink sheet (such as a magenta ink sheet) on the image receiving sheet having the cyan image thereon;

placing imagewise a thermal head on the support of the second heat sensitive ink sheet to form and transfer a color image (magenta image) of the heat sensitive ink material onto the image receiving sheet;

separating the support of the ink sheet from the image receiving sheet so that the color image (magenta image) of the heat sensitive ink material is retained on the image receiving sheet;

superposing a third heat sensitive ink sheet (such as a yellow ink sheet) on the image receiving sheet having the cyan image and magenta image thereon;

placing imagewise a thermal head on the support of the second heat sensitive ink sheet to form and transfer a color image (yellow image) of the heat sensitive ink material onto the image receiving sheet; and separating the support of the ink sheet from the image receiving sheet so that the color image (yellow image) of the heat sensitive ink material is retained on the image receiving sheet, whereby a multicolor image is formed on the image receiving sheet.

Further, thus prepared multicolor image can be transferred onto a white paper sheet.

In the process, the heat sensitive ink sheet of the invention can be employed as the first, second and third heat sensitive ink sheets.

Use of the heat sensitive ink sheet containing the colorless fine particles brings about an image which is almost free from glistening as well as has dots having preferable size and shape and good reproduction of gradation. The use of the heat sensitive ink sheet is particularly advantageous in the case of checking the transferred image onto the image receiving sheet without retransferring the transferred image onto the white paper sheet.

In more detail, even though a transferred image onto the image receiving layer (sheet) shows remarkable glistening, the retransferred image onto a white paper sheet (for printing) does not remarkable glistening because the surface of the white paper sheet is unevenness. However, in the case that the transferred image is checked against an original image before the transferred image is retransferred onto the white sheet paper, the glistening of the transferred image gives some troubles for checking the image. Therefore, the heat sensitive ink sheet of the invention is particularly useful in the case of checking the transferred image.

Figure 1:
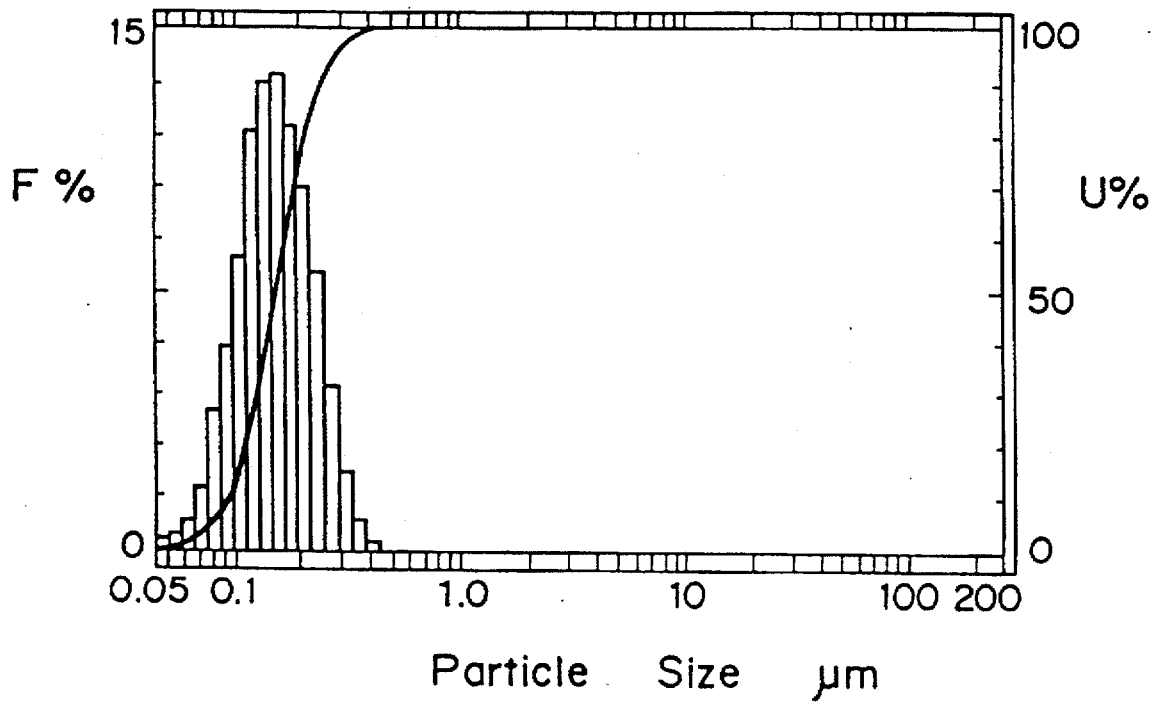
FIG. 1 shows a particle size distribution of cyan pigment employed in Example 1.

In each figure, the axis of abscissas indicates particle size (μm), the left axis of ordinates indicates percentage (%) of particles of the indicated particle sizes, and the right axis of ordinates indicates accumulated percentage (%).

DETAILED DESCRIPTION OF THE INVENTION

The heat sensitive ink sheet is advantageously employed in the image forming method of the invention for thermal transfer recording by area gradation is described below.

The heat sensitive ink sheet has a support sheet and a heat sensitive ink layer having a thickness of 0.2 to 1.0 μm which is formed of a heat sensitive ink material comprising 30 to 70 weight % of colored pigment, 25 to 65 weight % of amorphous organic polymer having a softening point of 40° to 150° C. and 0.5 to 25 weight % of colorless fine particles. The heat sensitive ink sheet can be particularly utilized in the formation of multigradation image (especially multicolor image) by area gradation (multi-valued recording), while the sheet can be naturally utilized in binary recording.

As the support sheet, any of the materials of the support sheets employed in the conventional fused ink transfer system and sublimation ink transfer system can be employed. Preferably employed is a polyester film of approx. 5 μm thick which has been subjected to release treatment.

The colored pigment to be incorporated into the heat sensitive ink layer of the invention can be optionally selected from known pigments. Examples of the known pigments include carbon black, azo-type pigment, phthalocyanine-type pigment, qunacridone-type pigment, thioindigo-type pigment, anthraquinone-type pigment, and isoindolin-type pigment. These pigments can be employed in combination with each other. A known dye can be employed in combination with the pigment for controlling hue of the color image.

The heat transfer ink layer of the invention contains the pigment in an amount of 30 to 70 weight % and preferably in an amount of 30 to 50 weight %. When the amount of the pigment is not less than 30 weight %, it is difficult to form an ink layer of the thickness of 0.2 to 1.0 μm which shows a high reflection density. Moreover, the pigment preferably has such particle distribution that at least 70 weight % of the pigment particles has a particle size of not less than 1.0 μm. A pigment particle of large particle size reduces transparency of the formed image, particularly in the area in which a number of color images are overlapped. Further, large particles bring about difficulty to prepare the desired ink layer satisfying the relationship between the preferred thickness and reflection density.

Any of amorphous organic polymers having a softening point of 40° to 150° C. can be employed for the preparation of the ink layer of the heat sensitive ink sheet of the invention. A heat-sensitive ink layer using an amorphous organic polymer having a softening point of lower than 40° C. shows unfavorable adhesion, and a heat-sensitive ink layer using an amorphous organic polymer having a softening point of higher than 150° C. shows poor sensitivity. Examples of the amorphous organic polymers include butyral resin, polyamide resin, polyethyleneimine resin, sulfonamide resin, polyester-polyol resin, petroleum resin, homopolymers and copolymers of styrene or its derivatives (e.g., styrene, vinyltoluene, α-methylstyrene, 2-methylstyrene, chlorostyrene, vinylbenzoic acid, sodium vinylbenzenesulfonate and aminostyrene), and homopolymers and copolymers of methacrylic acid or its ester (e.g., methacrylic acid, methyl methacrylate, ethyl methacrylate, butyl methacrylate, and hydroxyethyl methacrylate), homopolymers and copolymers of acrylic acid or its ester (e.g., acrylic acid, methyl acrylate, ethyl acrylate, butyl acrylate, and α-ethylhydroxy acrylate), homopolymers and copolymers of a diene compound (e.g., butadiene and isoprene), and homopolymers and copolymers of other vinyl monomers (e.g., acrylonitrile, vinyl ether, maleic acid, maleic acid ester, maleic anhydride, cinnamic acid, vinyl chloride, and vinyl acetate). Further, there can be mentioned copolymers of at least two monomers selected from methacrylic acid, its ester, methacrylic acid, its ester, a diene compound and other vinyl monomers, which are described above. These resins and polymers can be employed in combination.

Particularly preferred are butyral resin and styrenemaleic acid half ester resin, from the viewpoint of good dispersibility of the pigment.

Examples of trade names of the butyral resin include Denka butyral #2000-L (softening point: 57° C. (measured by DSC (Differential Scanning Calorimeter)); degree of polymerization: approx. 300) and Denka butyral #4000-1 (softening point: 57° C.; degree of polymerization: approx. 920) which are available from Denki Kagaku Kogyo Co., Ltd.; and Eslec BX-10 (softening point: 72° C.; Tg: 74° C., degree of polymerization: 80, acetyl value: 69 molar %) and Eslec BL-S (Tg: 61° C., viscosity: 12 cps) which are available from Sekisui Chemical Co., Ltd.

In the heat sensitive ink sheet of the invention, the ink layer contains the amorphous organic polymer having a softening point of 40° to 150° C. in an amount of 25 to 65 weight %, and preferably in an amount of 30 to 50 weight %.

The heat sensitive ink layer of the invention contains colorless fine particles, which include colorless transparent particles and colorless opaque particles (containing white particles). Examples of the colorless fine particles include inorganic particles such as silica, calcium carbonate, kaolin, clay, starch and zinc oxide; and organic particles such as cellulose powder, polymethylmethacrylate particles (generally used as matting agent) and polystyrene particles (e.g., polystyrene beads).

Preferred is silica. A mean particle size of the colorless fine particles generally is in the range of 0.005 to 1.5 μm, and preferably in the range of 0.01 to 0.7 μm.

The colorless fine particles are generally contained in the heat sensitive ink layer in an amount of 0.5 to 25 weight %, and preferably in an amount of 2 to 15 weight %. Further, the colorless fine particles are generally present on the support in an amount of 0.005 to 0.5 g per 1 $m^2$, and preferably in an amount of 0.01 to 0.2 g per 1 $m^2$.

The heat sensitive ink layer preferably contains at least one of nitrogen-containing compounds such as amide compounds. The nitrogen-containing compounds include amide compounds having a low melting point (preferably 50° to 150° C.) such as higher fatty acid amides (e.g., stearic acid amide, behenic acid amide and palmitic acid amide) and derivatives thereof (e.g., methylolstearoamide); and an amide compound having the formula (I) described above; an amine compound; a quaternary ammonium salt having the formula (II) or formula (III) (which is mentioned later), hydarazine, aromatic amine or a heterocyclic compound. Preferred are amide compounds such as the higher fatty acid amides and the amide compound having the formula (I).

The reason why the incorporation of the amide compound into the heat sensitive ink sheet brings about formation of good transferred image is presumed as follows: A sizing agent such as clay is contained in a paper for print (e.g., coated paper), and the compound has affinity for the sizing agent, whereby the transferring property can be improved and influence of environment on the transferring procedure can be reduced.

The amide compound having the formula (I) is explained. In the formula (I), $R^1$ generally is an alkyl group of 8 to 18 carbon atoms, an alkoxyalkyl group of 8 to 18 carbon atoms, an alkyl group of 8 to 18 carbon atoms having a hydroxyl group, or an alkoxyalkyl group of 8 to 18 carbon atoms having a hydroxyl group. $R^1$ preferably is an alkyl group of 8 to 18 carbon atoms (especially 12 to 18 carbon atoms) or an alkyl group of 8 to 18 carbon atoms (especially 12 to 18 carbon atoms) having a hydroxyl group. Examples of the alkyl groups include methyl, ethyl, isopropyl, n-propyl, n-butyl, isobutyl, tert-butyl, n-pentyl, n-hexyl, n-octyl, nonyl, decyl, undecyl, dodecyl, tridecyl, tetradecyl, pentadecyl, hexadecyl, heptadecyl and octadecyl.

$R^2$ generally represents a hydrogen atom, an alkyl group of 1 to 10 carbon atoms (especially 1 to 8 carbon atoms), an alkoxyalkyl group of 1 to 10 carbon atoms (especially 1 to 8 carbon atoms), an alkyl group of 1 to 10 carbon atoms having a hydroxyl group (especially 1 to 8 carbon atoms), or an alkoxyalkyl group of 1 to 10 carbon atoms having a hydroxyl group (especially 1 to 8 carbon atoms). $R^2$ preferably is an alkyl group of 1 to 10 carbon atom (especially 1 to 8 carbon atoms) or an alkyl group of 1 to 10 carbon atom (especially 1 to 8 carbon atoms) having a hydroxyl group. Examples of the alkyl groups include methyl, ethyl, isopropyl, n-propyl, n-butyl, isobutyl, tert-butyl, n-pentyl, n-hexyl, n-octyl, nonyl, decyl, undecyl, dodecyl, tridecyl, tetradecyl, pentadecyl, hexadecyl, heptadecyl and octadecyl.

$R^3$ preferably is a hydrogen atom, an alkyl group of 1 to 4 carbon atom (especially 1 to 3 carbon atoms). Especially, $R^3$ preferably is a hydrogen atom. Examples of the alkyl groups include methyl, ethyl, isopropyl, n-propyl, n-butyl, isobutyl and tert-butyl.

However, $R^1$ is not the alkyl group (i.e., $R^1$ is the alkoxyalkyl, the alkyl group having a hydroxyl group or the alkoxyalkyl having a hydroxyl group), in the case that $R^2$ and $R^3$ both represent a hydrogen atom.

The amide of the formula (I) can be prepared by reacting an acyl halide with amine (by adding acyl halide to an aqueous alkaline solution containing the amine) to introduce the acyl group into the amine, which is performed, for example, according to Schotten-Baumann method. In more detail, acyl halide is dropwise added to a chilled alkaline solution containing amine, and operations such as addition and mixing are conducted so as to maintain the reaction temperature of not higher than 15° C. In the reaction, use of amine, alkali and acyl halide in a ratio of 1:1:1 gives an amide compound.

In the case that amine which is sparingly soluble in water is used, an ether solution containing tertiary amine is employed instead of the aqueous alkaline solution. In more detail, an acyl halide is dropwise added to an ether solution containing amine and triethylamine. In the reaction, use of amine, triethylamine and an acyl halide in the ratio of 1:1:1 gives an amide compound. The obtained amide compound can be purified by recrystallization if desired, to give a pure amide compound.

The amide compound of the formula (I) can be, for example, prepared by using an acyl halide and amine in the combinations set forth in Table 1.

TABLE 1

| Acyl Halide | Amine |
|---|---|
| $CH_3(CH_2)_5CH(OH)(CH_2)_{10}COCl$ | $H_2NC_2H_4OH$ |
| $CH_3(CH_2)_5CH(OH)(CH_2)_{10}COCl$ | $NH_3$ |
| n-$C_9H_{19}COCl$ | $CH_3NH_2$ |
| n-$C_{15}H_{31}COCl$ | $CH_3NH_2$ |
| n-$C_{17}H_{35}COCl$ | $CH_3NH_2$ |
| n-$C_{17}H_{35}COCl$ | $C_2H_5NH_2$ |
| n-$C_{17}H_{35}COCl$ | n-$C_4H_9NH_2$ |
| n-$C_{17}H_{35}COCl$ | n-$C_6H_{13}NH_2$ |
| n-$C_{17}H_{35}COCl$ | n-$C_8H_{17}NH_2$ |
| n-$C_{17}H_{35}COCl$ | $H_2NC_2H_4OC_2H_4OH$ |
| n-$C_{17}H_{35}COCl$ | $(CH_3)_2NH$ |
| n-$C_{17}H_{35}COCl$ | $(C_2H_5)_2NH$ |

Examples of the obtained amide compounds are shown in Table 2. The compounds are indicated by $R^1$, $R^2$ and $R^3$ of the formula (I).

TABLE 2

| $R^1$ | $R^2$ | $R^3$ |
|---|---|---|
| $CH_3(CH_2)_5CH(OH)(CH_2)_{10}$ | $C_2H_4OH$ | H |
| $CH_3(CH_2)_5CH(OH)(CH_2)_{10}$ | H | H |
| n-$C_9H_{19}$ | $CH_3$ | H |
| n-$C_{15}H_{31}$ | $CH_3$ | H |
| n-$C_{17}H_{35}$ | $CH_3$ | H |
| n-$C_{17}H_{35}$ | $C_2H_5$ | H |

TABLE 2-continued

| $R^1$ | $R^2$ | $R^3$ |
|---|---|---|
| n-$C_{17}H_{35}$ | n-$C_4H_9$ | H |
| n-$C_{17}H_{35}$ | n-$C_6H_{13}$ | H |
| n-$C_{17}H_{35}$ | n-$C_8H_{17}$ | H |
| n-$C_{17}H_{35}$ | $C_2H_4OC_2H_4OH$ | H |
| n-$C_{17}H_{35}$ | $CH_3$ | $CH_3$ |
| n-$C_{17}H_{35}$ | $C_2H_5$ | $C_2H_5$ |

Subsequently, the quaternary ammonium salt of the formula (II) is explained below.

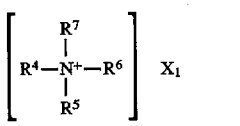

(II)

In the formula (II), $R^4$ preferably is an alkyl group of 1 to 12 carbon atom (especially 1 to 8 carbon atom) or an aryl group of 6 to 12 carbon atoms (e.g., phenyl or naphthyl). Examples of the alkyl groups include methyl, ethyl, isopropyl, n-propyl, n-butyl, isobutyl, tert-butyl, n-pentyl, n-hexyl and n-octyl. Each of $R^5$, $R^6$ and $R^7$ preferably is an alkyl group of 1 to 12 carbon atom (especially, 1 to 8 carbon atom) or an aryl group of 6 to 12 carbon atoms (e.g., phenyl or naphthyl). Examples of the alkyl groups include methyl, ethyl, isopropyl, n-propyl, n-butyl, isobutyl, tert-butyl, n-pentyl, n-hexyl and n-octyl. $X_1$ preferably is a halide ion, especially $Cl^-$ or $Br^-$.

Examples of the quaternary ammonium salts of the formula (II) include ammonium chloride, tetra-n-butylammonium bromide and triethylmethylammonium chloride.

The quaternary ammonium salt of the formula (III) described above is explained below.

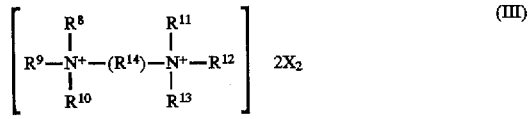

(III)

in which each of $R^8$, $R^9$, $R^{10}$, $R^{11}$, $R^{12}$ and $R^{13}$ independently represents a hydrogen atom, a hydroxyl group, an alkyl group of 1 to 18 carbon atom or an aryl group of 6 to 18 carbon atoms, $R^{14}$ represents an alkylene group of 1 to 12 carbon atom, and $X_2$ represents a monovalent anion.

The quaternary ammonium salt of the formula (III) is a dimmer of the quaternary ammonium salt, and the example includes hexamethonium bromide [i.e., hexamethylenebis (trimethylammonium bromide)].

Examples of the amines mentioned above include cyclohexylamine, trioctylamine and ethylenediamine.

Examples of the hydrazines mentioned above include dimethylhydradine.

Examples of the aromatic amines mentioned above include p-toluidine, N,N-dimethylaniline and N-ethylaniline.

Examples of the heterocyclic compounds mentioned above include N-methylpyrrole, N-ethylpyridinium bromide, imidazole, N-methylquinolinium bromide and 2-methylbenzothiazole.

The heat sensitive ink layer generally contains 1 to 30 weight % of the nitrogen-containing compound (preferably amide compound), and especially 5 to 20 weight % of the compound. The compound preferably exists in the heat sensitive ink sheet in the amount of 0.001 to 2 g per 1 $m^2$, especially in the amount of 0.01 to 0.5 g per 1 $m^2$.

The ink layer can further contain 1 to 20 weight % of additives such as a releasing agent and/or a softening agent based on the total amount of the ink layer so as to facilitate release of the ink layer from the support when the thermal printing (image forming) takes place and increase heat-sensitivity of the ink layer. Examples of the additives include a fatty acid (e.g., palmitic acid and stearic acid), a metal salt of a fatty acid (e.g., zinc stearate), a fatty acid derivative (e.g., fatty acid ester and its partial saponification product), a higher alcohol, a polyol derivative (e.g., ester of polyol), wax (e.g., paraffin wax, carnauba wax, montan wax, bees wax, Japan wax, and candelilla wax), low molecular weight polyolefin (e.g., polyethylene, polypropylene, and polybutyrene) having a viscosity mean molecular weight of approx. 1,000 to 10,000, low molecular weight copolymer of olefin (specifically α-olefin) with an organic acid (e.g., maleic anhydride, acrylic acid, and methacrylic acid) or vinyl acetate, low molecular weight oxidized polyolefin, halogenated polyolefin, homopolymer of acrylate or methacrylate (e.g., methacylate having a long alkyl chain such as lauryl methacrylate and stearyl methacrylate, and acrylate having a perfluoro group), copolymer of acrylate or methacrylate with vinyl monomer (e.g., styrene), low molecular weight silicone resin and silicone modified organic material (e.g., polydimethylsiloxane and polydiphenylsiloxane), cationic surfactant (e.g., pyridinium salt), anionic and nonionic surfactants having a long aliphatic chain group, and perfluoro-type surfactant.

The compounds are employed singly or in combination with two or more kinds.

The pigment and colorless fine particles can be appropriately dispersed in the amorphous organic polymer by conventional methods known in the art of paint material such as that using a suitable solvent and a ball mill. The nitrogen-containing compound and the additives can be added into the obtained dispersion to prepare a coating liquid. The coating liquid can be coated on the support according to a conventional coating method known in the art of paint material to form the heat-sensitive ink layer.

The thickness of the ink layer should be in the range of 0.2 to 1.0 μm, and preferably in the range of 0.3 to 0.6 μm (more preferably in the range of 0.3 to 0.5 μm). An excessively thick ink layer having a thickness of more than 1.0 μm gives an image of poor gradation on the shadow portion and highlight portion in the reproduction of image by area gradation. A very thin ink layer having a thickness o less than 0.2 μm cannot form an image of acceptable optical reflection density.

The heat-sensitive ink layer of the invention mainly comprises a pigment and an amorphous organic polymer, and the amount of the pigment in the layer is high, as compared with the amount of the pigment in the conventional ink layer using a wax binder. Therefore, the ink layer of the invention shows a viscosity of higher than $10^4$ cps at 150° C. (the highest thermal transfer temperature), while the conventional ink layer shows a viscosity of $10^2$ to $10^3$ cps at the same temperature. Accordingly, when the ink layer of the invention is heated, the ink layer per se is easily peeled from the support and transferred onto an image receiving layer keeping the predetermined reflection density. Such peeling type transfer of the extremely thin ink layer enables to give an image having a high resolution, a wide gradation from a shadow potion to a highlight portion, and satisfactory edge sharpness. Further, the complete transfer (100%) of image onto the image receiving sheet gives desired uniform reflection density even in a small area such as characters of 4 point and a large area such as a solid portion.

As for the image receiving sheet, any of the conventional sheet materials can be employed. For instance, a synthetic paper sheet which becomes soft under heating, and other image receiving sheet materials which has a heat-adhesive layer containing an organic polymer described in U.S. Pat. No. 4,482,625, No. 4,766,053, and No. 4,933,258 can be employed.

The image receiving sheet generally has a heat adhesive layer on a support.

The support of the image receiving sheet is made of material having chemical stability and thermostability and flexibility. If desired, the support is required to have a high transmittance at a wavelength of the light source using for the exposure. Examples of materials of the support include polyesters such as polyethylene terephthalate (PET); polycarbonate; polystyrene; cellulose derivatives such as cellulose triacetate, nitrocellulose and cellophane; polyolefins such as polyethylene and polypropylene; polyacrylonitrile; polyvinyl chloride; polyvinylidene chloride; polyacrylates such as PMMA (polymethyl methacrylate), polyamides such as nylon; polyimide and paper. Further, a paper sheet on which a polyethylene film is laminated may be employed. Preferred is a polyethylene terephthalate film. The support preferably is a biaxially stretched polyethylene terephthalate film. The thickness of the support generally is in the range of 5 to 300 μm, and preferably in the range of 25 to 200 μm.

The image receiving sheet generally comprises the support, a first image receiving layer and a second image receiving layer provided on the first image receiving layer.

The first image receiving layer generally has Young's modulus of 10 to 10,000 kg·f/cm$^2$ at room temperature. Young's modulus of the first image receiving layer preferably is 10 to 200 kg·f/cm$^2$ at room temperature.

Examples of polymer materials employed in the first image receiving layer include polyolefins such as polyethylene and polypropylene; copolymers of ethylene and other monomer such as vinyl acetate or acrylic acid ester; polyvinyl chloride; copolymers of vinyl chloride and other monomer such vinyl acetate or vinyl alcohol; copolymer of vinyl acetate and maleic acid; polyvinylidene chloride; copolymer containing vinylidene chloride; polyacrylate; polymethacrylate; polyamides such as copolymerized nylon and N-alkoxymethylated nylon; synthetic rubber; and chlorinated rubber. Preferred are polyvinyl chloride, copolymer of vinyl chloride and vinyl acetate, copolymer of vinyl chloride and vinyl alcohol and copolymer of vinyl acetate and maleic acid. The degree of polymerization preferably is in the range of 200 to 2,000.

In the case that polyvinyl chloride or copolymer containing vinyl chloride unit is employed, an organic tintype stabilizer such as tetrabutyltin or tetraoctyltin is preferably incorporated into the polymer or copolymer.

The first image receiving layer generally contains plasticizer. Examples of the plasticizers include polyester, multifunctional acrylate monomer (acrylate monomer having a number of vinyl groups such as acryloyl or methacryloyl group), urethane origomer and copolymers of a monomer having ethylene group and fatty acid vinyl ester or (meth)-acrylic acid alkyl ester.

A thickness of the first image receiving layer preferably is in the range of 1 to 50 μm, especially 5 to 30 μm.

The second image receiving layer comprises polymer. Examples of these polymers include polyolefins such as butyral resin; polyethylene and polypropylene; copolymers of ethylene and other monomer such as vinyl acetate or acrylic acid ester; polyvinyl chloride; copolymers of vinyl chloride and other monomer such vinyl acetate; copolymer containing vinylidene chloride; polystyrene; copolymer of styrene and other monomer such as maleic acid ester; polyvinyl acetate; butyral resin; modified polyvinyl alcohol; polyamides such as copolymerized nylon and N-alkoxymethylated nylon; synthetic rubber; chlorinated rubber; phenol resin; epoxy resin; urethane resin; urea resin; melamine resin; alkyd resin; maleic acid resin; copolymer containing hydroxystyrene; sulfonamide resin; rosin ester; celluloses; and rosin.

The second image receiving layer can contain a surface-active agent, surface lubricant, plasticizer or agent for improving adhesion in order to control bonding strength between the second image receiving sheet and the first image receiving layer or the heat sensitive ink layer. Further, it is preferred to employ a solvent not to dissolve or swell the resin contained in the first image receiving layer as a solvent used in a coating liquid for forming the second image receiving layer. For example, when polyvinyl chloride, which easily dissolves in various solvents, is used as a resin of the first image receiving layer, a solvent used in the coating liquid of the second image receiving layer preferably is alcohols or solvents mainly containing water.

A thickness of the second receiving layer preferably is in the range of 0.1 to 10 μm, especially 0.5 to 5.0 μm.

In order to control the bonding strength between the first and second image receiving layers, materials contained in the first and second image receiving layers are generally different from each other mentioned above; for example, the materials are used in combination of hydrophilic polymer and liophilic polymer, in combination of polar polymer and nonpolar polymer, or as the materials additives such as surface-active agent, surface lubricant such as a fluorine compound or silicone compound, plasticizer or agent for improving adhesion such as silane coupling agent are appropriately used.

Subsequently, the image forming method of the invention is described below.

The image forming method (thermal transfer recording) of the invention can be, for example, performed by means of a thermal head (generally using as thermal head printer) and a laser beam using the heat sensitive ink sheet of the invention and the above image receiving sheet.

The method utilizing the thermal head can be conducted by the steps of: superposing the heat sensitive ink sheet having the support and the heat sensitive ink layer of the invention on the image receiving sheet; placing imagewise a thermal head the support of the heat sensitive ink sheet to form and transfer an image of the heat sensitive ink material of the ink layer onto the image receiving sheet (generally the second image receiving layer) by separating the support from the image receiving sheet. The formation of the image using the thermal head is generally carried out utilizing area gradation. The transferred image onto the image receiving layer has an optical reflection density of at least 1.0.

Subsequently, the following procedure can be performed. After a white paper sheet is prepared which generally is a support for printing, the image receiving sheet having the transferred image is superposed on the white paper sheet in such a manner that the transferred image is in contact with a surface of the white sheet, and the composite is subjected to pressing and heating treatments, and the image receiving sheet (having the first image receiving layer) is removed from the composite whereby the retransferred image can be formed on the white paper sheet (together with the second image receiving layer). The transferred image onto the white sheet has an optical reflection density of at least 1.0.

The above formation of the image can be generally conducted using the thermal head printer by means of area gradation.

Further, the method utilizing the a laser beam can be conducted by using a laser beam instead of the above thermal head in the above thermal transfer recording method. The thermal transfer recording method utilizing the a laser beam can utilize methods (i.e., ablation method) described in U.S. Pat. No. 5,352,562 and Japanese Patent Provisional Publication No. 6(1994)-219052. The method of Japanese Patent Provisional Publication No. 6(1994)-219052 is performed by the steps of: superposing a heat sensitive ink sheet comprising a support and a heat sensitive ink layer (image forming layer) between which a light-heat conversion layer capable of converting an absorbed laser beam into heat energy and a heat sensitive peeling layer containing heat sensitive material capable of producing a gas by absorbing the heat energy (or only a light-heat conversion layer further containing the heat sensitive material) are provided on the image receiving sheet in such a manner that the heat sensitive ink layer is in contact with a surface of the image receiving sheet; irradiating imagewise a laser beam the composite (the heat sensitive ink sheet and the image receiving sheet) to enhance temperature of the light-heat conversion layer; causing ablation by decomposition or melting of materials of the light-heat conversion layer and decomposing a portion of the heat sensitive peeling layer to produce a gas, whereby bonding strength between the heat sensitive ink layer and the light-heat conversion layer reduces; and transferring the heat sensitive ink layer corresponding to the portion onto the image receiving layer.

The above formation of the image utilizing the ablation can be generally carried out by means of area gradation. The transferred image on the image receiving sheet has also an optical reflection density of at least 1.0. Further, the transferred image can be retransferred onto the white paper sheet, and the retransferred image on the white paper sheet has an optical reflection density of at least 1.0.

Otherwise, in the above method utilizing the ablation, formation of the image can be also conducted by the steps of portionwise melting the heat sensitive ink layer by means of heat energy given by absorption of a laser beam, and transferring the portion onto the image receiving sheet under melting.

The light-heat conversion layer and heat sensitive peeling layer mentioned above are explained below.

The light-heat conversion layer basically comprises a coloring material (e.g., dye or pigment) and a binder.

Examples of the coloring material include black pigments such as carbon black, pigments of large cyclic compounds such as phthalocyanine and naphthalocyanine absorbing a light having wavelength from visual region to infrared region, organic dyes such as cyanine dyes (e.g., indolenine compound), anthraquinone dyes, azulene dyes and phthalocyanine dyes which are employed as laser absorbing materials of high-density laser recording media such as an optical disc, and dyes of organic metal compounds such as dithiol nickel complex. The light-heat conversion layer preferably is as thin as possible to enhance recording sensitivity, and therefore dyes such as cyanine and phthalocyanine having a large absorption coefficient are preferably employed.

Examples of the binder include homopolymer or copolymer of acyrylic monomers such as acrylic acid, methacrylic acid, acrylic acid ester and methacrylic acid ester; celluloses such as methyl cellulose, ethyl cellulose and cellulose acetate; vinyl polymers such as polystyrene, vinyl chloride/vinyl acetate copolymer, polyvinyl pyrrolidone, polyvinyl butyral and polyvinyl alcohol; polycondensation polymers such as polyester and polyamide; and thermoplastic polymers containing rubber butadiene/styrene copolymer. Otherwise, the binder may be a resin formed by polymeization or cross-linkage of monomers such as epoxy compounds by means of light or heating.

A ratio between the amount of the coloring material and that of the binder preferably is in the range of 1:5 to 10:1 (coloring material:binder), especially in the range of 1:3 to 3:1. When the amount of the binder is more than the upper limit, cohesive force of the light-heat conversion layer lowers and therefore the layer is apt to transfer onto the image receiving sheet together with the heat sensitive ink layer in the transferring procedure. Further, the light-heat conversion layer containing excess binder needs a large thickness to show a desired light absorption, which occasionally results in reduction of sensitivity.

The thickness of the light-heat conversion layer generally is in the range of 0.05 to 2 μm, and preferably 0.1 to 1 μm. The light-heat conversion layer preferably shows light absorption of not less than 70% in a wavelength of a used laser beam.

The heat sensitive peeling layer is a layer containing a heat sensitive material. Examples of the material include a compound (e.g., polymer or low-molecular weight compound) which is itself decomposed or changed by means of heating to produce a gas; and a compound (e.g., polymer or low-molecular weight compound) in which a relatively volatile liquid such as water has been adsorbed or absorbed in marked amount. These compounds can be employed singly or in combination of two kinds.

Examples of the polymers which are itself decomposed or changed by means of heating to produce a gas include self-oxidizing polymers such as nitrocellulose; polymers containing halogen atom such as chlorinated polyolefin, chlorinated rubber, polyvinyl chloride and polyvinylidene chloride; acrylic polymers such as polyisobutyl methacylate in which relatively volatile liquid such as water has been adsorbed; cellulose esters such as ethyl cellulose in which relatively volatile liquid such as water has been adsorbed; and natural polymers such as gelatin in which relatively volatile liquid such as water has been adsorbed.

Examples of the low-molecular weight compounds which are itself decomposed or changed by means of heating to produce a gas include diazo compounds and azide compounds.

These compounds which are itself decomposed or changed preferably produce a gas at a temperature not higher than 280° C., especially produce a gas at a temperature not higher than 230° C. (preferably a temperature not lower than 100° C.).

In the case that the low-molecular weight compound is employed as the heat sensitive material of the heat sensitive peeling layer, the compound is preferably employed together with the binder. The binder may be the polymer which itself decomposes or is changed to produce a gas or a conventional polymer having no property mentioned above. A ratio between the low-molecular weight compound and the binder preferably is in the range of 0.02:1 to 3:1 by weight, especially 0.05:1 to 2:1.

The heat sensitive peeling layer is preferably formed on the whole surface of the light-heat conversion layer. The thickness preferably is in the range of 0.03 to 1 μm, especially 0.05 to 0.5 μm.

The present invention is further described by the following Examples and Comparison Examples. The term "part(s)" indicated in Examples means "weight part(s)".

EXAMPLE 1

(1) Preparation of heat sensitive ink sheet

The following three pigment dispersions were prepared:

| | |
|---|---|
| A) Cyan pigment dispersion | |
| Cyan Pigment (CI, P.B. 15:4) | 12.0 parts |
| Silica particles (Aerosil R972, mean particle size: 0.03 μm, available from Nippon Aerosil Co., Ltd.) | 2.4 parts |
| Binder solution | 122.8 parts |
| B) Magenta pigment dispersion | |
| Magenta Pigment (CI, P.R. 57:1) | 12.0 parts |
| Silica particles (above mentioned) | 2.4 parts |
| Binder solution | 122.8 parts |
| C) Yellow pigment dispersion | |
| Yellow Pigment (CI, P.Y. 14) | 12.0 parts |
| Silica particles (above mentioned) | 2.4 parts |
| Binder solution | 122.8 parts |

The binder solution comprised the following components:

| | |
|---|---|
| Butyral resin (softening point: 57° C., Denka Butyral #2000-L, available from Denki Kagaku Kogyo K.K.) | 12.0 parts |
| Solvent (n-propyl alcohol) | 110.0 parts |
| Dispersing agent (Solsparese S-20000, available from ICI Japan Co., Ltd. | 0.8 parts |

Figure 2:
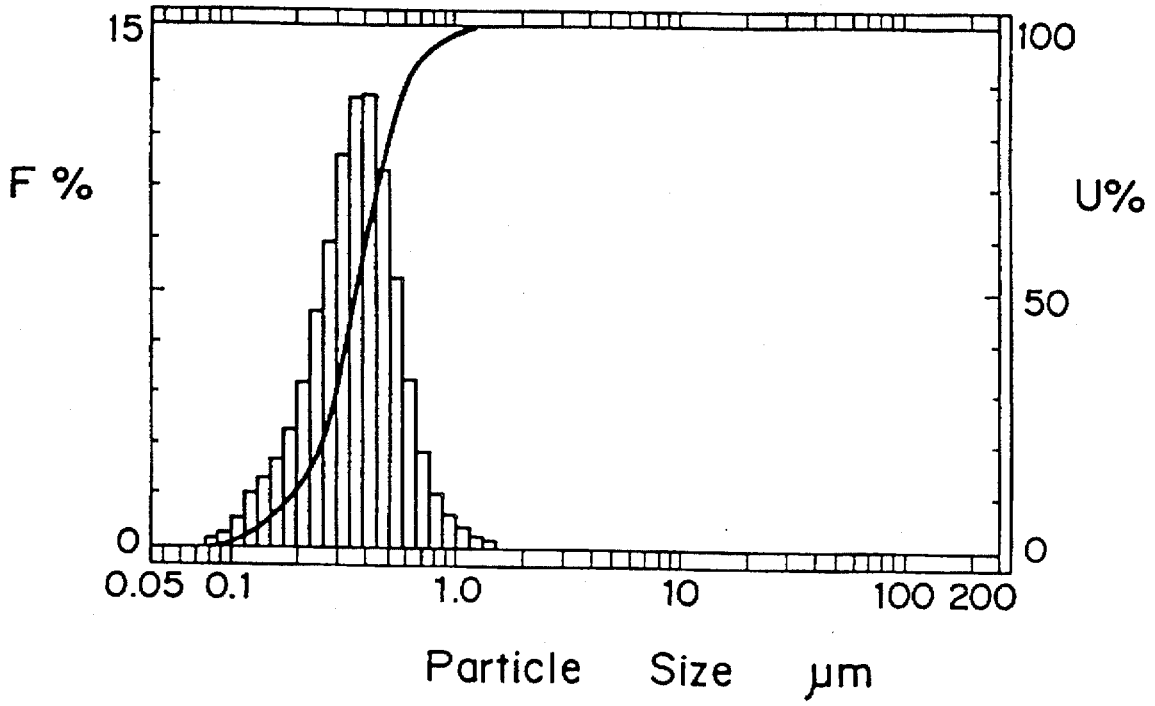
FIG. 2 shows a particle size distribution of magenta pigment employed in Example 1.

The particle size distribution of the pigments in the dispersions are shown in the attached figures, wherein FIG. 1 indicates the distribution of cyan pigment; FIG. 2 indicates the distribution of magenta pigment; and FIG. 3 indicates the distribution of yellow pigment. In each figure, the axis of abscissas indicates particle size (μm), the left axis of ordinates indicates percentage (%) of particles of the indicated particle sizes, and the right axis of ordinates indicates accumulated percentage (%).

Figure 3:
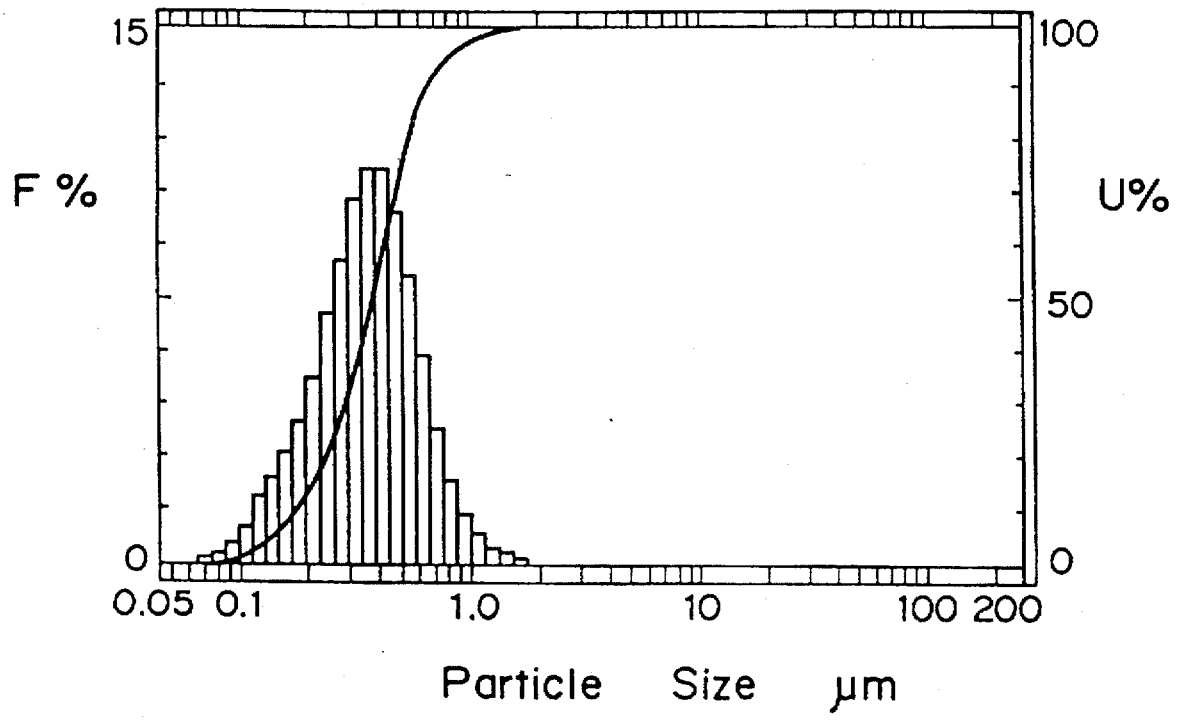
FIG. 3 shows a particle size distribution of yellow pigment employed in Example 1.

In FIG. 1, a median size of the particles is 0.154 μm, the specific surface is 422,354 $cm^2/cm^3$, and 90% of the total particles have particle sizes of not less than 0.252 μm. In FIG. 2, a median size of the particles is 0.365 μm, the specific surface is 189,370 $cm^2/cm^3$, and 90% of the total particles have particle sizes of not less than 0.599 μm. In FIG. 3, a median size of the particles is 0.364 μm, the specific surface is 193,350 $cm^2/cm^3$, and 90% of the total particles have particle sizes of not less than 0.655 μm.

To 10 parts of each pigment dispersion were added 0.24 part of N-hydroxyethyl-12-hydroxystearic acid amide (amide compound A), 0.01 part of surface active agent (Megafack F-177, available from Dainippon Ink & Chemicals Inc.) and 60 parts of n-propyl alcohol to give a coating liquid. Each of thus obtained coating liquids [A), B) and C) corresponding to the pigment dispersions A), B) and C)] was coated using a whirler on a polyester film (thickness: 5 μm, available from Teijin Co., Ltd.) with a back surface having been made easily releasable. Thus, a cyan ink sheet having a support and a cyan ink layer of 0.36 μm, a magenta ink sheet having a support and a magenta ink layer of 0.38 μm, and a yellow ink sheet having a support and a yellow ink layer of 0.42 μm, were prepared.

(2) Preparation of Image Receiving Sheet

The following coating liquids for first and second image receiving layers were prepared:

| | |
|---|---|
| (Coating liquid for first image receiving layer) | |
| Vinyl chloride/vinyl acetate copolymer (MPR-TSL, available from Nisshin Kagaku Co., Ltd.) | 25 parts |
| Dibutyloctyl phthalate (DOP, Daihachi Kagaku Co., Ltd.) | 12 parts |
| Surface active agent (Megafack F-177, available from Dainippon Ink & Chemicals Inc.) | 4 parts |
| Solvent (Methyl ethyl ketone) | 75 parts |
| (Coating liquid for second image receiving layer) | |
| Butyral resin (Denka Butyral #2000-L, available from Denki Kagaku Kogyo K.K.) | 16 parts |
| N,N-dimethylacrylamide/butyl acrylate copolymer | 4 parts |
| Surface active agent (Megafack F-177, available from Dainippon Ink & Chemicals Inc.) | 0.5 part |
| Solvent (n-propyl alcohol) | 200 parts |

The above coating liquid for first image receiving layer was coated on a polyethylene terephthalate film (thickness: 100 μm) using a whirler rotating at 300 rpm, and dried for 2 minutes in an oven of 100° C. to form a first image receiving layer (thickness: 20 μm) on the film.

Subsequently, the above coating liquid for second image receiving layer was coated on the first image receiving layer using a whirler rotating at 200 rpm, and dried for 2 minutes in an oven of 100° C. to form a second image receiving layer (thickness: 2 μm).

[Image Formation Using Thermal Head]

Using the heat sensitive ink sheets and the image receiving sheet obtained above, the image formation was performed as follows:

Initially, the cyan heat sensitive ink sheet was superposed on the image receiving sheet, and a thermal head was placed on the cyan ink sheet side for imagewise forming a cyan image by the known divided sub-scanning method. The divided sub-scanning method was performed with multiple modulation for giving area gradation by moving a thermal head of 75 μm×50 μm in one direction at a pitch of 3 μm along 50 μm length. The support (polyester film) of the cyan ink sheet was then peeled off from the image receiving sheet on which a cyan image with area gradation was maintained. On the image receiving sheet having the cyan image was superposed the magenta ink sheet, and the same procedure was repeated for forming a magenta image with area gradation on the image receiving sheet having the cyan image. The yellow ink sheet was then superposed on the image receiving sheet having the cyan and magenta images thereon in the same manner, and the same procedure was repeated for forming a yellow image with area gradation on the image receiving sheet. Thus, a multicolor image was formed on the image receiving layer.

[Evaluation of Color Image Obtained]

(1) The following was optical reflection density of a solid portion of each color image:

Cyan image: 1.53

Magenta image: 1.43

Yellow image 1.58

(2) Further, the color image was tested as to shape of dot and glistening. The shape of dot and glistening evaluated by visual observation of ten persons.

i) The shape of dot was ranked based on evaluation (BB) of image in Comparison Example 1 (mentioned later), as follows:

CC: permissible level though a little unsatisfactory compared with shape of dot in Comparison Example 1 ii) The glistening was ranked based on evaluation (DD) of image in Comparison Example 1 (mentioned later), as follows:

AA: excellent compared with glistening in Comparison Example 1

BB: good compared with glistening in Comparison Example 1

The results of these evaluation are set forth in Table 4.

EXAMPLES 2–5

The procedures of Example 1 were repeated except for using the particles and amid indicated in Table 3 instead of Aerosil R972 and N-hydroxyethyl-12-hydroxystearic acid amide to prepare heat sensitive ink sheets (cyan ink sheet, magenta ink sheet and yellow ink sheet).

A multicolor image was prepared in the same manner as Example 1 using the heat sensitive ink sheets and the image receiving sheet prepared in the same manner as Example 1.

Optical reflection density of a solid portion of each color image was the same as Example 1. The results of other evaluations are set forth in Table 4.

COMPARISON EXAMPLE 1

The procedures of Example 1 were repeated except for using no Aerosil R972 to prepare heat sensitive ink sheets (cyan ink sheet, magenta ink sheet and yellow ink sheet).

A multicolor image was prepared in the same manner as Example 1 using the heat sensitive ink sheets and the image receiving sheet prepared in the same manner as Example 1.

Optical reflection density of a solid portion of each color image was the same as Example 1. The results of other evaluations are set forth in Table 4.

TABLE 3

| | Particles | [Mean particle size; μm] | Amide compound |
|---|---|---|---|
| Ex. 1 | Silica (Aerosil R972, available from Nippon Aerosil Co., Ltd.) | [0.03] | Amide compound A |
| Ex. 2 | Silica (Aerosil 200, available from Nippon Aerosil Co., Ltd.) | [0.02] | Amide compound A |
| Ex. 3 | Silica (Mizucasil P527, available from Mizusawa Chemical Co., Ltd.) | [1.0] | Amide compound A |
| Ex. 4 | PMMA matting agent (MP-3100, available from Soken Kagaku Co., Ltd.) | [0.5] | Amide compound A |
| Ex. 5 | Silica (Aerosil R972, available from Nippon Aerosil Co., Ltd.) | [0.03] | Amide compound B |
| Co. Ex. 1 | — | | Amide compound A |

Note;
Amide compound A: N-hydroxyethyl-12-hydroxystearic acid amide
Amide compound B: stearic acid amide

TABLE 4

| | Shape of Dot | Glistening |
|---|---|---|
| Example 1 | BB | BB |
| Example 2 | BB | BB |
| Example 3 | CC | BB |
| Example 4 | BB | BB |
| Example 5 | BB | BB |
| Comp. Example 1 | BB | DD |

As is apparent from the results in Table 4, use of the heat sensitive ink sheets obtained in Examples 1 to 5 gives image having good shape of dot and reduced glistening.

EXAMPLE 6

Heat sensitive ink sheets and an image receiving sheet were prepared below. Then, a composite of a heat sensitive sheet and an image receiving sheet was irradiated with a laser beam to form a transferred image in the following manner.

(1) Preparation of Heat Sensitive Ink Sheet

1) Preparation of coating liquid for light-heat conversion layer

The following components were mixed using a stirrer to prepare a coating liquid for light-heat conversion layer:

| | |
|---|---|
| Cyanine dye absorbing infrared rays of the following structure: | 0.3 part |

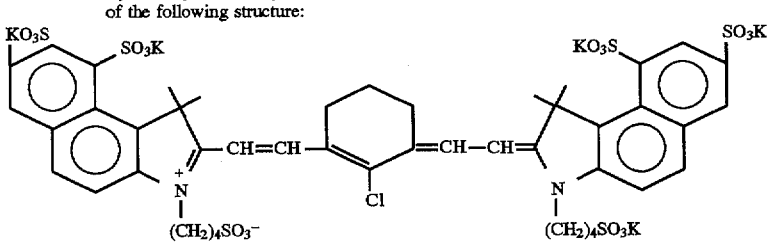

| | |
|---|---|
| 5% Aqueous solution of polyvinyl alcohol (#205, available from Kuraray Co., Ltd.) | 6 parts |
| Isopropyl alcohol | 5 parts |
| Ion exchanged water | 20 parts |
| Dye absorbing infrared ray (IR-820, available from | 1.7 part |

-continued

| | |
|---|---|
| Nippon Kayaku Co., Ltd.) | |
| Varnish of polyamic acid (PAA-A, available from Mitsui Toatsu Chemicals, Inc.) | 13 parts |
| 1-Methoxy-2-propanol | 60 parts |
| Methyl ethyl ketone | 88 parts |
| Surface active agent (Megafack F-177, available from Dainippon Ink & Chemicals Inc.) | 0.05 part |

2) Formation of light-heat conversion layer

A first subbing layer comprising styrene/butadiene copolymer (thickness: 0.5 μm) and a second subbing layer comprising gelatin (thickness: 0.1 μm) were formed on a polyethylene terephthalate film (thickness: 75 μm) in order. Then, the above coating liquid for light-heat conversion layer was coated on the second subbing layer using a whirler, and dried for 2 minutes in an oven of 100° C. to form a light-heat conversion layer (thickness: 0.2 μm measured by feeler-type thickness meter, absorbance of light of 830 nm: 1.4).

3) Preparation of coating liquid for heat sensitive peeling layer

The following components were mixed using a stirrer to prepare a coating liquid for heat sensitive peeling layer:

| | |
|---|---|
| Nitrocellulose (HIG120, available from Asahi Chemical Co., Ltd.) | 1.3 part |
| Methyl ethyl ketone | 26 parts |
| Propylene glycol monomethylether acetate | 40 parts |
| Toluene | 92 parts |
| Surface active agent (Megafack F-177, available from Dainippon Ink & Chemicals Inc.) | 0.01 part |

4) Formation of heat sensitive peeling layer

The above coating liquid for heat sensitive peeling layer was coated on the light-heat conversion layer using a whirler, and dried for 2 minutes in an oven of 100° C. to form a heat sensitive peeling layer (thickness: 0.1 μm (obtained by measuring with feeler-type thickness meter a layer formed by coating the liquid on a surface of a hard sheet in the same manner as above)).

5) Preparation of coating liquid for heat sensitive ink layer (image forming layer) of magenta The following components were mixed using a stirrer to prepare a coating liquid for heat sensitive ink layer for magenta image:

Preparation of Mother Liquor

| | |
|---|---|
| Polyvinyl butyral (Denka Butyral #2000-L available from Denki Kagaku Kogyo K.K.) | 12.6 parts |
| Magenta pigment (C.I. P.R.57:1) | 18 parts |
| Silica particles (Aerosil R972, mean particle size: 0.03 μm, available from Nippon Aerosil Co., Ltd.) | 3.6 parts |
| Dispersing agent (Solspers S-20000, available from ICI Japan Co., Ltd.) | 0.8 part |
| n-Propyl alcohol | 110 parts |
| Glass beads | 100 parts |

The above materials were placed in a paint shaker (available from Toyo Seiki Co., Ltd.) and were subjected to dispersing treatment for two hours to prepare the mother liquor. The obtained mother liquor was diluted with n-propyl alcohol, and particle size distribution of the pigments in the diluted liquid was measured by a particle size measuring apparatus (utilizing laser beam scattering system). The measurement showed that the pigments of not less than 70 weight % had particle size of 180 to 300 nm.

Preparation of Coating Liquid

| | |
|---|---|
| Mother liquor prepared above | 6 part |
| n-Propyl alcohol | 60 parts |
| Amide compound A (N-hydroxyethyl-12-hydroxystearic acid amide) | 0.2 part |
| Surface active agent (Megafack F-177, available from Dainippon Ink & Chemicals Inc.) | 0.01 part |

The above components were mixed with a stirrer to prepare a coating liquid for forming a heat sensitive ink layer of magenta.

6) Formation of Heat Sensitive Ink Layer of Magenta

The above coating liquid for heat sensitive ink layer of magenta image was coated on the heat sensitive peeling layer using a whirler, and dried for 2 minutes in an oven of 100° C. to form a heat sensitive ink layer (thickness: 0.3 μm (obtained by measuring with feeler-type thickness meter a layer formed by coating the liquid on a surface of a hard sheet in the same manner as above)). The obtained ink layer showed optical transmission density of 0.7 (measured by Macbeth densitometer using green filter).

Thus, a heat sensitive ink sheet (magenta image) composed of a support, a light-heat conversion layer, a heat sensitive peeling layer and heat sensitive ink layer of magenta image wherein a number of crystals of amide compound A were dispersed on the layer, was prepared.

(2) Preparation of Image Receiving Sheet

The following coating liquids for first and second image receiving layers were prepared:

| (Coating liquid for first image receiving layer) | |
|---|---|
| Vinyl chloride copolymer (Zeon 25, available from Nippon Geon Co., Ltd.) | 9 parts |
| Surface active agent (Megafack F-177, available from Dainippon Ink & Chemicals Inc.) | 0.1 part |
| Methyl ethyl ketone | 130 parts |
| Toluene | 35 parts |
| Cyclohexanone | 20 parts |
| Dimethyl formamide | 20 parts |
| (Coating liquid for second image receiving layer) | |
| Methyl methacrylate/ethyl acrylate/metacrylic acid copolymer (Diyanal BR-77, available from Mitsubishi Rayon Co., Ltd.) | 17 parts |

-continued

| | |
|---|---|
| Alkyl acrylate/alkyl methacrylate copolymer (Diyanal BR-64, available from Mitsubishi Rayon Co., Ltd.) | 17 parts |
| Pentaerythritol tetraacrylate (A-TMMT, available from Shin Nakamura Kagaku Co., Ltd.) | 22 parts |
| Surface active agent (Megafack F-177P, available from Dainippon Ink & Chemicals Inc.) | 0.4 part |
| Methyl ethyl ketone | 100 parts |
| Hydroquinone monomethyl ether | 0.05 part |
| Photopolymerization initiator (2,2-dimethoxy-2-phenylacetophenone) | 1.5 part |

The above coating liquid for first image receiving layer was coated on a polyethylene terephthalate film (thickness: 75 μm) using a whirler, and dried for 2 minutes in an oven of 100° C. to form a first image receiving layer (thickness: 1 μm) on the film.

Subsequently, the above coating liquid for second image receiving layer was coated on the first image receiving layer using a whirler, and dried for 2 minutes in an oven of 100° C. to form a second image receiving layer (thickness: 26 μm).

Thus, the image receiving sheet was prepared.

(3) Preparation of Composite for Forming Image

The above heat sensitive ink sheet and the above image receiving sheet were allowed to stand at room temperature for one day, and they were placed at room temperature in such a manner that the heat sensitive ink layer and the second image receiving layer came into contact with each other and passed through a couple of heat rollers under conditions of 70° C., 4.5 kg/cm and 2 m/sec. to form a composite. Temperatures of the sheets when passed through the rollers were measured by a thermocouple. The temperatures each were 50° C.

(4) Fixation of Composite on Image Forming Device

The above composite was cooled at room temperature for 10 minutes. Then, the composite was wound around a rotating drum provided with a number of suction holes in such a manner that the image receiving sheet was in contact with a surface of the rotating drum, and the composite was fixed on the rotating drum by sucking inside of the drum.

(5) Image Recording

The laser beam (λ:830 nm, out-put power: 110 mW) was focused at a beam diameter of 7 μm on the surface of the light-heat conversion layer of the composite to record a image (line), while, by rotating the drum, the laser beam was moved in the direction (sub-scanning direction) perpendicular to the rotating direction (main-scanning direction).

Main-scanning rate: 10 m/sec.

Sub-scanning pitch (Sub-scanning amount per one time): 5 μm (6) Formation of Transferred Image The recorded composite was removed from the drum, and the heat sensitive ink sheet was peeled off from the image receiving sheet to obtain the image receiving sheet having the transferred image (lines) of the heat sensitive ink material wherein lines of magenta having width of 5.0 μm were formed in only the irradiation portion of the laser beam.

(7) Evaluation

Optical reflection density of a solid portion of each color image was the same as Example 1. Further, the color image was tested as to shape of dot and glistening in the same manner as in Example 1.

i) The shape of dot was ranked based on evaluation (BB) of image in Comparison Example 2 (mentioned later), as follows:

CC: permissible level though a little unsatisfactory compared with shape of dot in Comparison Example 2 ii) The glistening was ranked based on evaluation (DD) of image in Comparison Example 2 (mentioned later), as follows:

AA: excellent compared with glistening in Comparison Example 2

BB: good compared with glistening in Comparison Example 2

The results of these evaluation are set forth in Table 6.

EXAMPLES 7–10

The procedures of Example 6 were repeated except for using the particles or amid indicated in Table 5 instead of Aerosil R972 and N-hydroxyethyl-12-hydroxystearic acid amide which are contained in a coating liquid for heat sensitive ink layer to prepare heat sensitive ink sheets (cyan ink sheet, magenta ink sheet and yellow ink sheet).

A multicolor image was prepared in the same manner as Example 6 using the heat sensitive ink sheets and the image receiving sheet prepared in the same manner as Example 6. The same transferred image as in Example 6 was obtained.

Optical reflection density of a solid portion of each color image was the same as in Example 1. The results of other evaluations are set forth in Table 6.

COMPARISON EXAMPLE 2

The procedures of Example 6 were repeated except for using no Aerosil R972 which is contained in a coating liquid for heat sensitive ink layer to prepare heat sensitive ink sheets (cyan ink sheet, magenta ink sheet and yellow ink sheet).

A multicolor image was prepared in the same manner as Example 6 using the heat sensitive ink sheets and the image receiving sheet prepared in the same manner as Example 6.

Optical reflection density of a solid portion of each color image was the same as Example 1. The results of other evaluations are set forth in Table 6.

TABLE 5

| | Particles | [Mean particle size; μm] | Amide compound |
|---|---|---|---|
| Ex. 6 | Silica (Aerosil R972, available from Nippon Aerosil Co., Ltd.) | [0.03] | Amide compound A |
| Ex. 7 | Silica (Aerosil 200, available from Nippon Aerosil Co., Ltd.) | [0.02] | Amide compound A |
| Ex. 8 | Silica (Mizucasil P527, available from Mizusawa Chemical Co., Ltd.) | [1.0] | Amide compound A |
| Ex. 9 | PMMA matting agent (MP-3100, available from Soken Kagaku Co., Ltd.) | [0.5] | Amide compound A |
| Ex. 10 | Silica (Aerosil R972, available from Nippon Aerosil Co., Ltd.) | [0.03] | Amide compound B |
| Co. Ex. 2 | — | | Amide compound A |

Note;
Amide compound A: N-hydroxyethyl-12-hydroxystearic acid amide
Amide compound B: stearic acid amide

TABLE 6

| | Shape of Dot | Glistening |
|---|---|---|
| Example 6 | BB | BB |
| Example 7 | BB | BB |
| Example 8 | CC | BB |
| Example 9 | BB | BB |
| Example 10 | BB | BB |
| Comp. Example 1 | BB | DD |

As is apparent from the results in Table 6, use of the heat sensitive ink sheets obtained in Examples 6 to 10 gives image having good shape of dot and reduced glistening, even when the formation of image was performed using a laser beam.

What is claimed is:

1. A heat sensitive ink sheet having a support sheet and a heat sensitive ink layer having a thickness of 0.2 to 1.0 μm which is formed of a heat sensitive ink material comprising 30 to 70 weight % of colored pigment, wherein at least 70 weight % of said colored pigment comprises particles having a particle size of 0.1 to 0.1 μm, 25 to 65 weight % of amorphous organic polymer having a softening point of 40° to 150° C., and 0.5 to 25 weight % of colorless fine particles having a mean particle size of 0.01 to 0.7 μm.

2. The heat sensitive ink sheet as defined in claim 1, wherein the colorless fine particles are silica particles.

3. The heat sensitive ink sheet as defined in claim 1, wherein the heat sensitive ink layer contains an amide compound.

4. The heat sensitive ink sheet as defined in claim 3, wherein the amide compound has the formula (I):

$$R^1-\underset{\underset{O}{\|}}{C}-\underset{\underset{R^3}{|}}{N}-R^2$$

in which $R^1$ represents an alkyl group of 8 to 24 carbon atoms, an alkoxyalkyl group of 8 to 24 carbon atoms, an alkyl group of 8 to 24 carbon atoms having a hydroxyl group, or an alkoxyalkyl group of 8 to 24 carbon atoms having a hydroxyl group, and each of $R^2$ and $R^3$ independently represents a hydrogen atom, an alkyl group of 1 to 12 carbon atoms, an alkoxyalkyl group of 1 to 12 carbon atoms, an alkyl group of 1 to 12 carbon atoms having a hydroxyl group, or an alkoxyalkyl group of 1 to 12 carbon atoms having a hydroxyl group, provided that $R^1$ is not the alkyl group in the case that $R^2$ and $R^3$ both represent a hydrogen atom.

5. An image forming method which comprises the steps of:

superposing the heat sensitive ink sheet of claim 1 on an image receiving sheet;

placing imagewise a thermal head on the support of the heat sensitive ink sheet to form an image of the ink material with area gradation on the image receiving sheet; and separating the support of the heat sensitive ink sheet from the image receiving sheet so that the image of the ink material can be retained on the image receiving sheet, said image of the ink material on the image receiving sheet having an optical reflection density of at least 1.0.

6. An image forming method which comprises the steps of:

superposing the heat sensitive ink sheet of claim 1 on an image receiving sheet;

irradiating a laser beam modulated by digital signals on the heat sensitive ink layer through the support of the heat sensitive ink sheet to form an image of the ink material on the image receiving sheet; and separating the support of the heat sensitive ink sheet from the image receiving sheet so that the image of the ink material can be retained on the image receiving sheet, said image of the ink material on the image receiving sheet having an optical reflection density of at least 1.0.

7. An image forming method which comprises the steps of:

superposing the heat sensitive ink sheet of claim 1 on an image receiving sheet;

irradiating a laser beam modulated by digital signals on the heat sensitive ink layer through the support of the heat sensitive ink sheet to form an image of the ink material on the image receiving sheet through ablation of the image from the support of the heat sensitive ink sheet; and separating the support of the heat sensitive ink sheet from the image receiving sheet so that the image of the ink material can be retained on the image receiving sheet, said image of the ink material on the image receiving sheet having an optical reflection density of at least 1.0.

* * * * *